United States Patent [19]

Kishizuka

[11] Patent Number: 4,652,164

[45] Date of Patent: Mar. 24, 1987

[54] DEVICE TO PREVENT THE INADVERTENT COMING-APART OF THE PARTS OF A DRAFTSMAN'S INK WRITING INSTRUMENT

[75] Inventor: Terumasa Kishizuka, Tokyo, Japan

[73] Assignee: Kishizuka Kikai Kogyo Kabushiki Kaisha, Tokyo, Japan

[21] Appl. No.: 702,698

[22] Filed: Feb. 19, 1985

[30] Foreign Application Priority Data

| | | | |
|---|---|---|---|
| Feb. 17, 1984 | [JP] | Japan | 59-20607[U] |
| Apr. 9, 1984 | [JP] | Japan | 59-50837[U] |
| Apr. 9, 1984 | [JP] | Japan | 59-50838[U] |

[51] Int. Cl.[4] ..... B43K 1/10; B43K 1/06; B43K 17/00

[52] U.S. Cl. ..... 401/258; 401/259

[58] Field of Search ..... 401/258, 259, 260

[56] References Cited

U.S. PATENT DOCUMENTS

| | | | |
|---|---|---|---|
| 264,854 | 9/1882 | Brown | 401/260 |
| 1,409,037 | 3/1922 | Starkey et al. | 401/260 |
| 1,528,142 | 3/1925 | Bourquin | 401/259 |
| 2,878,783 | 3/1959 | Cholet | 401/258 |
| 3,535,048 | 10/1970 | Bok | 401/258 |

FOREIGN PATENT DOCUMENTS

| | | | |
|---|---|---|---|
| 1461640 | 2/1969 | Fed. Rep. of Germany | 401/259 |
| 1807848 | 5/1970 | Fed. Rep. of Germany | 401/259 |
| 1930388 | 12/1970 | Fed. Rep. of Germany | 401/259 |
| 1073878 | 6/1967 | United Kingdom | 401/258 |

*Primary Examiner*—Steven A. Bratlie

*Attorney, Agent, or Firm*—Oblon, Fisher, Spivak, McClelland & Maier

[57] ABSTRACT

A draftsman's ink writing instrument having a falling down prevention member axially and movably received in the axial through bore of the outer case. The falling down prevention member is sized and shaped so that it is resiliently biased against the inner surface of an upper, larger diameter part of the axial through bore in the outer case but will not pass downwardly beyond a tapered annular shoulder between the upper, larger diameter part of the axial through bore and a middle, smaller diameter part of the axial through bore.

7 Claims, 12 Drawing Figures

DEVICE TO PREVENT THE INADVERTENT COMING-APART OF THE PARTS OF A DRAFTSMAN'S INK WRITING INSTRUMENT

FIELD OF THE INVENTION

The instant invention relates to a device for preventing the inadvertent coming-apart of the parts of a draftsman's ink writing instrument.

BACKGROUND OF THE INVENTION

Conventional draftsman's ink writing instruments are structured as shown in FIG. 1. In such conventional draftsman's ink writing instruments, an outer case 1 has three cylindrical stages of different external diameters and an axial through bore which likewise has three stages having different internal diameters. The largest diameter portion of the outer case 1 is referred to herein as the ink reservoir 2, and the part of the axial through bore contained therein functions as an ink reservoir. The medium diameter portion of the outer case 1 contains the medium diameter portion of the axial through bore and is referred to herein as an operation part 3. The small diameter portion of the outer case 1 contains the small diameter portion of the axial through bore and is referred to herein as the writing part 4. The writing part 4 contains an ink flow hole 7 which is open to the bottom of the outer case 1, while the ink reservoir part 2 is open at the top of the outer case 1. A tapered annular shoulder 5 is formed in the inner surface of the axial through bore between the reservoir and the portion of the axial through bore in the operation part 3. An external annular step shoulder 6 is formed on the outer case 1 at the level of the bottom of the tapered annular shoulder 5. Further, a tapered annular shoulder 8 is formed in the inner surface of the axial through bore at the juncture between the medium diameter portion and the small diameter portion thereof.

An ink flow stopping piece 9 is inserted in the outer case 1. The ink flow stopping piece 9 has a needle part 10 which is located in the ink flow hole 7 and the end of which projects through the ink flow hole 7. The ink flow stopping piece 9 also has a flowing down prevention part 12 which has a tapered flow stopping surface 11. The tapered flow stopping surface 11 valves the tapered annular shoulder 8 to prevent the flowing down of the ink. The flowing down prevention part 12 is of cylindrical shape and is sized so that an annular gap is present around it. A weight 14 is connected to the upper surface of the flowing down prevention part 12 by a connecting rod 13.

Such a conventional draftsman ink writing instrument prevents external leakage of ink by surface tension when the ink reservoir is filled with ink. The flowing down of the ink is prevented by the annular engagement of the tapered annular shoulder 8 with the corresponding tapered flow stopping surface 11 on the ink flow stopping piece 9, and the tapered flow stopping surface 11 is biased into engagement with the tapered annular shoulder 8 by the force of gravity operating on the weight 14.

When performing character or line writing with the conventional draftsman's instrument shown in FIG. 1, a grip holding member 18 is pivotally supported at the desired angle to the end of a fork-shaped holding member 16 attached to the end of a pen holder 15 by a pin 17 as shown in FIG. 2. The grip holding member 18 grippingly holds the outer surface of the operation part 3 of the outer case 1 with a forked grip holding part 19 attached to the end of the grip holding member 18. The grip holding member 18 keeps the ink flow stopping piece 9 from dropping out by holding the head of the weight 14 with the suspender 20 formed integrally with the forked grip holding part 19 and extending upwardly.

When it is desired to draw a circle, a leg 22 of a compass 21 holds the outer case 1 as shown in FIG. 3. An attachment 24 having a bore 23 is mounted on the leg 22 of the compass 21, and the operation part 3 of the outer case 1 is inserted into the attachment 24 and is gripped by tightening an adjusting screw 25.

When a draftsman performs character or line writing using the pen holder 15 or the compass 21, the needle part 10 is touched to the paper, forcing the ink flow stopping piece 9 upwardly, and the tapered flow stopping surface 11 separates from the tapered annular shoulder 8 to allow ink to flow down. The ink flows down the ink flow hole 7, and a line of the thickness corresponding to the outer diameter of the writing part 4 is formed.

In the above draftsman ink writing instrument, the needle part 10 required to write a fine line is itself very fine. The needle part 10 may be easily bent, particularly when the ink flow stopping piece 9 falls out of the outer case 1. Therefore, a U-shaped clip 26 has been conventionally fitted to the outer wall of the ink reservoir 2 so that the ink flow stopping piece 9 will not fall out when the apparatus is turned upside down.

However, a serious drawback of this conventional construction is that, because one side of the U-shaped clip 26 is placed in the ink reservoir, the ink may leak out due to capillary action.

Moreover, in those apparatuses intended to write thick lines, the needle part 10 is thick, and the total weight of the ink flow stopping piece 9 is large. In that case, the U-shaped clip 26 cannot stop the inadvertent coming out of the ink flow stopping piece 9. Therefore, the ink flow stopping piece 9 comes out when the apparatus is turned upside down, and the ink loses its surface tension and flows out of the ink reservoir. Such an eventuality may cause trouble by making stains on the paper surface or the draftsman's clothes.

OBJECT OF THE INVENTION

Therefore, this invention was devised to avoid ink leaking out by capillary action. Additionally, the ink will not flow out if the apparatus is placed upside down.

SUMMARY OF THE INVENTION

To avoid ink leaking out due either to capillary action or to the ink flow stopping piece inadvertently falling out due to its own weight, the subject invention provides a falling down prevention member which is axially and movably received in the upper, larger diameter part of the axial through bore. The falling down prevention member is sized and shaped so that it is resiliently biased against the inner surface of the upper, large diameter part of the axial through bore but will not pass downwardly beyond the tapered annular shoulder between the upper, larger diameter part of the axial through bore and the medium diameter, intermediate part of the axial through bore. Moreover, the falling down prevention member has an inserting hole sized, shaped, and positioned to receive the connecting rod and to permit the falling down prevention member to be slid radially into position around the connecting rod.

DETAILED DESCRIPTION OF THE PRESENTLY PREFERRED EMBODIMENTS

The First Embodiment

Figure 1:
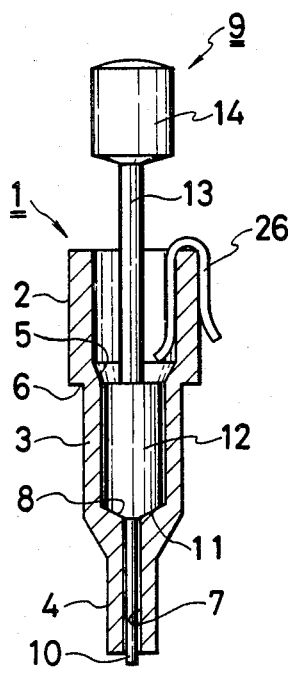
FIG. 1 PRIOR ART
FIG. 1 is an enlarged longitudinal section of a conventional draftsman's pen.
Figure 2:
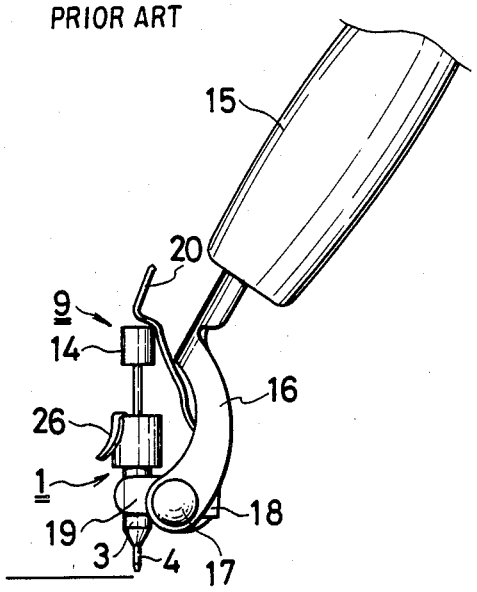
FIG. 2 PRIOR ART
FIG. 2 is an enlarged side view of the apparatus of FIG. 1 attached to a penholder.
Figure 3:
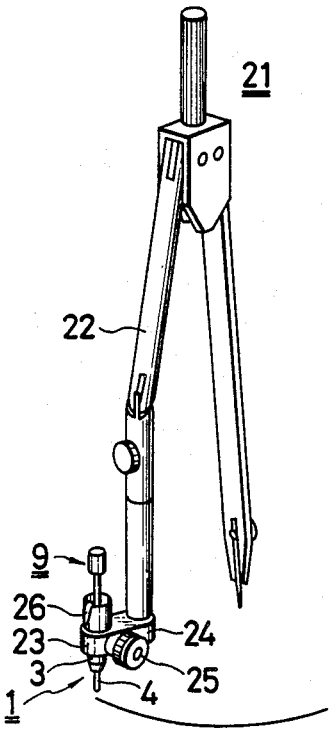
FIG. 3 PRIOR ART
FIG. 3 is a perspective view of the apparatus of FIG. 1 attached to a compass.
Figure 4:
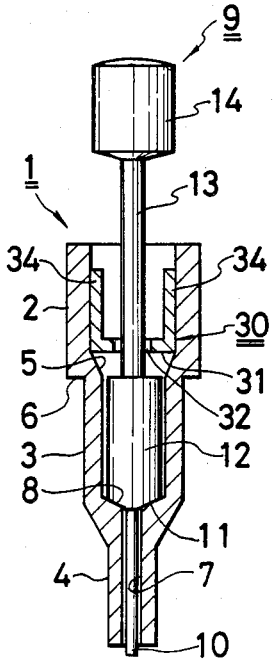
FIG. 4 is an enlarged longitudinal sectional view of a first embodiment of the present invention.
Figure 5:
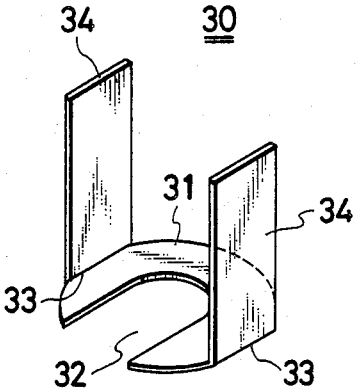
FIG. 5 is a perspective view on an enlarged scale of a falling down prevention member used in the first embodiment.

A first embodiment of the invention is illustrated in FIGS. 4 and 5. It is identical to the conventional draftsman's pen shown in FIG. 1 except that a falling down prevention member 30 inserted in the ink reservoir 2 has replaced the U-shaped clip 26.

The falling down prevention member 30 is composed of a thin metallic circular falling down prevention board 31 having a slightly larger diameter than the inner diameter of the ink reservoir 2. The circular falling down prevention board 31 has a U-shaped inserting hole 32 sized and shaped to allow radial insertion of the connecting rod 13. The diameter of the inserting hole 32 is smaller than the outer diameter of the flowing down prevention part 12. Straight line parts 33, 33 are formed on both sides of the circular falling down prevention board 31, and rectangular legs 34, 34 made of springy material (preferrably spring steel) project upwardly from the falling down prevention board 31.

Connecting rod 13 of the ink flow stopping piece 9 is inserted radially into the inserting hole 32, and the ink flow stopping piece 9 and the falling down prevention member 30 are inserted in the ink reservoir 2, as shown in FIG. 4. Axial movement of the falling down prevention member 30 is stopped at the tapered annular shoulder 5. Because the outer diameter of the falling down prevention board 31 is a little larger than the inner diameter of the ink reservoir 2, it is fixed firmly by friction. Further, the falling down prevention member 30 is attached rigidly in place by the spring force of the rectangular legs 34, 34.

When ink is filled in the ink reservoir 2, the ink passes through the inserting hole 32 in the falling down prevention board 31 and flows inbetween the flowing down prevention part 12 and the operation part 3. Contact of the tapered flow stopping surface 11 and the tapered annular shoulder 8 prevents flowing out of the ink.

In use, the ink flow stopping piece 9 is raised by touching the needle part 10 to the paper as in the conventional case, and the required character, etc., may be written.

When the pen is held upside down,, although the ink flow stopping piece 9 moves axially, the flowing down prevention part 12 contacts the falling down prevention board 31 of the falling down prevention member 30, preventing further axial movement of the ink flow stopping piece 9. Further, the ink is prevented from flowing out of the ink reservoir 2 by surface tension.

In the first exemplary embodiment, the falling down prevention board 31 has a circular form. However, the falling down prevention board 31 is not necessarily limited to having a circular form. Various forms can be adopted.

In the first exemplary embodiment, the falling down prevention member 30 can be fixed in place by contacting both rectangular legs 34, 34 elastically to the inside surface of the ink reservoir 2. Thus, the falling down prevention board 31 can be fixed in place without inclination by the rectangular legs 34, 34.

Because the falling down prevention member 30 is rigidly fixed in place, the coming out of the ink flow stopping piece 9 can be completely prevented when the apparatus is held upside down, and flow out of the ink can be prevented.

The Second Embodiment

A second exemplary embodiment will now be explained with reference to FIG. 6. The falling down prevention member 30*a* of the second exemplary embodiment has rectangular legs 34*a*, 34*a* formed from elastic material protruding axially from both sides of the falling down prevention board 31. The rectangular legs 34*a*, 34*a* are bent outwardly from bending lines 35, 35 to give sufficient friction to prevent the coming out of the ink flow stopping piece 9 when the falling down prevention member 30*a* is inserted in the ink reservoir 2.

Except as stated above, the second embodiment is identical to the first embodiment.

The Third Embodiment

Figure 7:
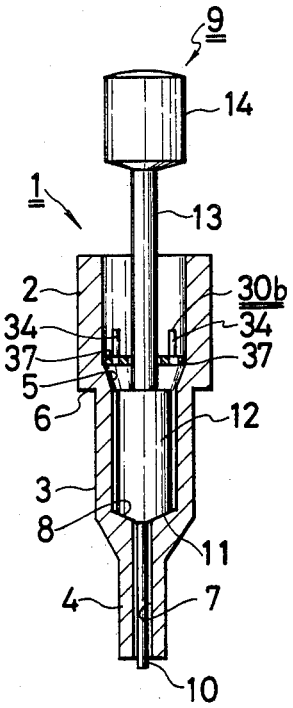
FIG. 7 is an enlarged longitudinal sectional view of a third embodiment.
Figure 8:
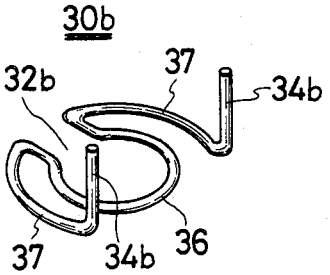
FIG. 8 is a perspective view of the falling down prevention member used in the third embodiment.

A third exemplary embodiment is next explained with reference to FIG. 7 and FIG. 8. In this embodiment, the falling down prevention member 30*b* is formed by bending steel material having elasticity (such a piano-wire) as shown in FIG. 8. An inserting hole 32*b* has a width which allows insertion of the connecting rod 13 of the ink flow stopping piece 9. A circular falling down prevention part 36 has a diameter smaller than the outer diameter of the flowing down prevention part 12. Circularly shaped fixing parts 37, 37 have a diameter slightly larger than the internal diameter of the ink reservoir 2. The open ends of the fixing parts 37, 37 are bent in the upper direction to form legs 34*b*, 34*b*.

When the legs 34*b*, 34*b* of the falling down prevention member 30*b* structured as above are pressed inwardly, the diameters of the fixing parts 37, 37 become smaller. The ink flow stopping piece 9 and the falling down prevention member 30*b* are inserted into the outer case 1 until the falling down prevention member 30*b* contacts the tapered annular shoulder 5 at the bottom of the ink reservoir 2. Then the legs 34*b*, 34*b* are freed, and the fixing parts 37, 37 expand their diameter until they are strongly pressed against the inside of the ink reservoir 2 by their elastic force, and the falling down prevention member 30*b* is fixed in place by their frictional force.

When ink is filled in the ink reservoir 2, the ink passes through the gaps between fixing parts 37, 37 and the falling down prevention part 36.

Figure 6:
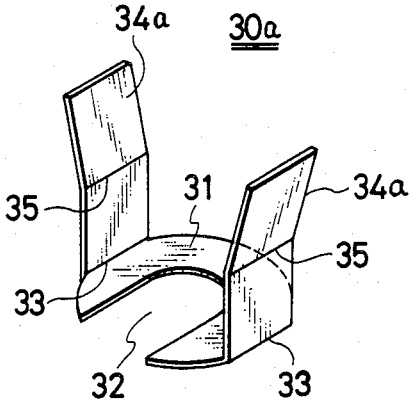
FIG. 6 is a perspective view of a falling down prevention member according to a second embodiment.

Although the falling down prevention part 36 is shown as circular in FIG. 6, it should be noted that it can also be made in a U-shape.

In the third exemplary embodiment, the elastic force of the two fixing parts 37, 37 of the falling down prevention member 30*b* tends to expand in both directions to strongly hold the falling down prevention member 30*b* in the ink reservoir 2.

Because the legs 34*b*, 34*b* project upwardly, the legs 34*b*, 34*b* can be held during the operations of attaching and removing the falling down prevention member 30*b* from the ink reservoir 2, making the attaching and removing operations easy.

Further, the falling down prevention member 30*b* is fixed rigidly in place. Thus, the coming out of the ink flow stopping piece 9 can be prevented completely when the instrument is placed upside down.

The Fourth Embodiment

Figure 9:
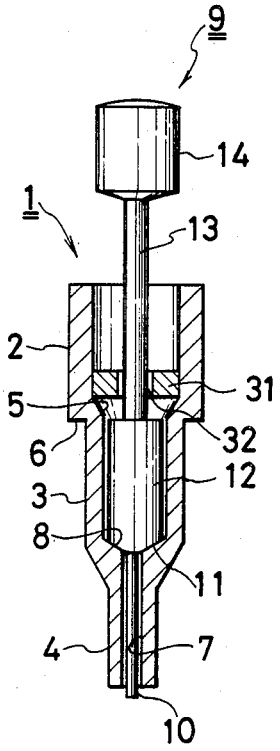
FIG. 9 is an enlarged longitudinal sectional view of a fourth embodiment.
Figure 10:
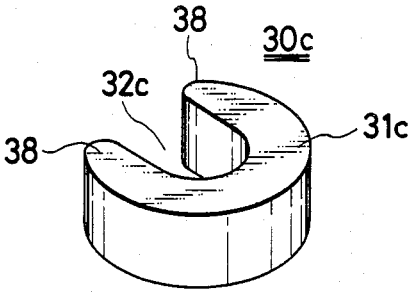
FIG. 10 is a perspective view of the falling down prevention member used in the fourth embodiment.

A fourth exemplary embodiment will now be explained with reference to FIGS. 9 and 10. The falling down prevention member 30*c* has a circular shape as shown in FIG. 10 and is formed with an outer diameter larger than the inner diameter of the ink reservoir 2. However, the thickly formed falling down prevention board 31*c* is made of a resilient material, such as plastic. An inserting hole 32*c* opens to one side of the falling down prevention board 31*c* in open ends 38, 38. As with the other embodiments, the inserting hole 32*c* has a width larger than the diameter of the connecting rod 13 of the ink flow stopping piece 9 and smaller than the diameter of the flowing down prevention part 12. The surfaces of the open ends 38, 38 of the falling down prevention board 31*c* have circular arc shapes.

After the connecting rod 13 of the ink flow stopping piece 9 is inserted into the insertion hole 32*c*, the open ends 38, 38 of the inserting hole 32*c* are squeezed. Consequently, the diameter of the outer circumference of the falling down prevention member 30*c* is made smaller. The falling down prevention member 30*c* is then inserted into the ink reservoir 2 until it is stopped by the tapered annular shoulder 5. The open ends 38, 38 are then released, permitting the falling down prevention member 30*c* to try to recover its original shape. The falling down prevention member 30*c* is thus pressed against the internal surface of the ink reservoir 2 and is strongly held in place by its elastic force.

The Fifth Embodiment

Figure 11:
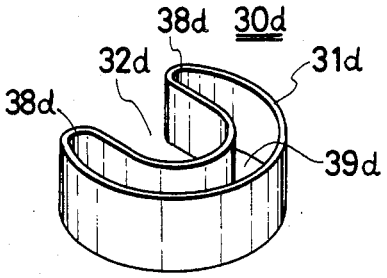
FIG. 11 is a perspective view of the falling down prevention member of a fifth embodiment.

A fifth exemplary embodiment will now be explained with reference to FIG. 11. The fifth exemplary embodiment has a hollow space 39*d* between the inserting hole 32*d* and the circumference of the falling down prevention board 31*d*. Otherwise, the fifth embodiment is similar to the fourth embodiment. As for the material, any resilient material, such as natural rubber, synthetic resin, or spring metal may be selected.

The fifth exemplary embodiment allows ink to flow down through the hollow space 39*d*. When inserting or removing the falling down prevention member 30*d* to or from the ink reservoir 2, the operation of holding the falling down prevention member 30*d* and narrowing the inserting hole 32*d* may be performed easily by inserting a tool in the vicinity of open ends 38*d*, 38*d* of the hollow space 39*d*.

The Sixth Embodiment

Figure 12:
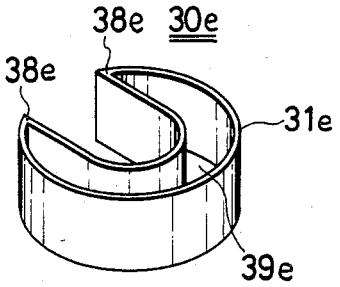
FIG. 12 is a perspective view of the falling down prevention member of a sixth embodiment.

A sixth exemplary embodiment will now be explained with reference to FIG. 12. The sixth exemplary embodiment has a hollow space 39*e*, as in the case of the fifth exemplary embodiment. However, the sixth embodiment is formed with sharp open ends 38*e*, 38*e*. Otherwise, the sixth embodiment is the same as the fifth exemplary embodiment in function and effect.

I claim:

1. A draftsman's ink writing instrument comprising:

(a) an outer case having a radially closed axial through bore, said axial through bore comprising:

(i) an upper, larger diameter part which functions as an ink reservoir;

(ii) a middle, intermediate diameter part, a first tapered annular shoulder being formed between said upper, larger diameter part and said middle, intermediate diameter part; and (iii) a lower, smaller diameter part, a second tapered annular shoulder being formed between said middle, intermediate diameter part and said lower, smaller diameter part;

(b) an ink flow stopping piece received in said axial through bore, said ink flow stopping piece being axially movable between a first position and a second position, said ink flow stopping piece comprising:

(i) a needle part which extends through said lower, smaller diameter part of said axial through bore and which projects beyond the lower end of said outer case when said ink flow stopping piece is in its first position;

(ii) a flowing down prevention part received in said middle, intermediate diameter part of said axial through bore, said flowing down prevention part having a tapered flow stopping surface sized, shaped, and positioned to make surface engagement with said second tapered annular shoulder to define the first position of said ink flow stopping piece and to valve the flow of ink from said upper, larger diameter part of said axial through bore to said lower, smaller diameter part of said axial through bore when said ink flow stopping piece is in its first position;

(iii) a connecting rod projecting upwardly from said flowing down prevention part through said upper, larger diameter part of said axial through bore; and (iv) a weight mounted on the upper end of said connecting rod; and (c) a falling down prevention member axially movably received in said upper, larger diameter part of said axial through bore, said falling down prevention member being sized and shaped so that:

(i) it does not contact said flowing down prevention member when said ink flow stopping piece is in its first position;

(ii) it is resiliently biased against the inner surface of said upper, larger diameter part of said axial through bore;

(iii) it will not pass downwardly beyond said first tapered annular shoulder between said upper, larger diameter part and said middle, intermediate diameter part of said axial through bore; and (iv) it contacts said flowing down prevention member when said draftsman's ink writing instrument is turned upside down, thereby limiting axial movement of said ink flow stopping piece and defining the second position of said ink flow stopping piece, said falling down prevention member having a radially extending inserting hole sized, shaped, and positioned to receive said connecting rod without distortion of said falling down prevention member and to permit said falling down prevention member to be slid radially into position around said connecting rod.

2. A draftsman's ink writing instrument as recited in claim 1 wherein said falling down prevention member comprises:

(a) a thin, circular, planar falling down prevention board having a slightly larger diameter than the diameter of said upper, larger diameter part of said axial through bore and (b) two legs projecting axially from said thin, circular, planar falling down prevention board, said legs being sized, shaped, and positioned to engage the inner walls of said upper, larger diameter part of said axial through bore.

3. A draftsman's ink writing instrument as recited in claim 2 wherein said legs are bent radially outwardly at a distance from said thin, circular, planar falling down prevention board.

4. A draftsman's ink writing instrument as recited in claim 1 wherein said falling down prevention member is composed of a bent wire.

5. A draftsman's ink writing instrument as recited in claim 1 wherein said falling down prevention member is composed of a thick piece of a resilient material.

6. A draftsman's ink writing instrument as recited in claim 4 wherein said falling down prevention member comprises:

(a) an inner circular portion;

(b) an outer circular portion;

(c) approximately radially extending portions joining said inner circular portion to said outer circular portion and defining said radially extending inserting hole; and (d) legs that extend axially from the ends of said outer circular portion.

7. A draftsman's ink writing instrument as recited in claim 1 wherein:

(a) said falling down prevention member comprises:

(i) an inner axially extending, part-circular wall;

(ii) an outer axially extending, part-circular wall;

(iii) approximately radially and axially extending walls joining said inner and outer axially extending, part-circular walls and defining said radially extending inserting hole; and (iv) a planar bottom joining said inner and outer axially extending, part-circular walls and said approximately radially and axially extending walls and (b) said inner and outer axially extending, part-circular walls, said approximately radially and axially extending walls, and said planar bottom defining a hollow space into which a tool may be inserted to insert and remove said falling down prevention member from said axial through bore.

* * * * *